United States Patent [19]

Britton et al.

[11] 4,376,597

[45] Mar. 15, 1983

[54] PULL-OUT DIAPHRAGM SEAL FOR HOLLOW TUBES

[75] Inventors: Frederick G. Britton, Bedford; William G. Stanfield, Dallas; Don B. Landers, Arlington, all of Tex.

[73] Assignee: Oil States Industries, Inc., Arlington, Tex.

[21] Appl. No.: 240,563

[22] Filed: Mar. 4, 1981

[51] Int. Cl.[3] ..... E02B 3/16

[52] U.S. Cl. ..... 405/195; 405/227; 138/89; 220/234

[58] Field of Search ..... 138/89; 405/224, 225, 405/227, 195; 220/233, 234, 240, 319, 328

[56] References Cited

U.S. PATENT DOCUMENTS

| | | | |
|---|---|---|---|
| 4,058,330 | 11/1977 | Wolf | 138/89 |
| 4,142,371 | 3/1979 | Mayfield et al. | 405/224 |
| 4,175,592 | 11/1979 | Coone | 138/89 |
| 4,215,951 | 8/1980 | Knox | 138/89 |
| 4,249,576 | 2/1981 | Streich et al. | 138/89 |
| 4,292,004 | 9/1981 | Knox | 138/89 |

*Primary Examiner*—Steven M. Pollard
*Assistant Examiner*—D. Voorhees
*Attorney, Agent, or Firm*—Arnold, White & Durkee

[57] ABSTRACT

A diaphragm seal assembly for large tubes such as used as supporting legs in offshore platforms and pile drivers in underwater environments, with the diaphragm seal closure constructed to resist loads retained in such manner as to be nearly completely removed by upward tension pull on a pull-out cable. The diaphragm seal assembly is retained between rings welded inside a tubular member by a split ring forced apart to a retaining diameter by a removable key. Pull on a cable removes the key allowing the split ring to return to its initial smaller diameter size small enough to be removed up out of the tube along with the diaphragm closure member.

19 Claims, 9 Drawing Figures

PULL-OUT DIAPHRAGM SEAL FOR HOLLOW TUBES

Figure 1:
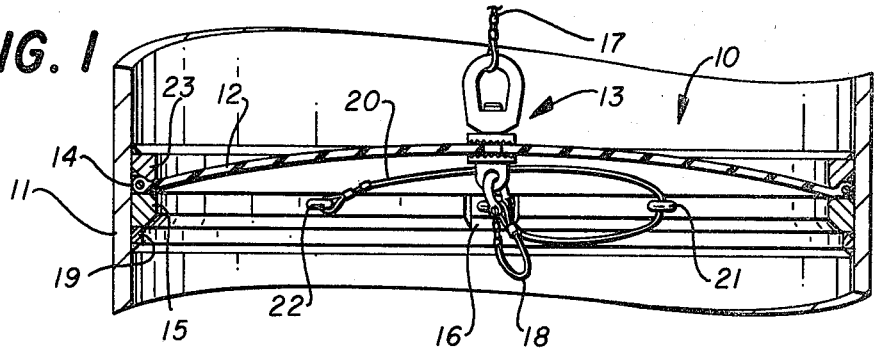

This invention relates in general to seal assemblies for closing tubular members, pile guides, legs or standards of platforms to facilitate floating with a sealed enclosure against water leakage or prevent entry of silt or debris and, in particular, to a diaphragm seal of the heavy-duty reinforced type capable of withstanding relatively high pressures over relatively large areas in a pull-out structure that removes the entire diaphragm seal and accompanying removable items via a single sustained pull on the removing cable.

Through recent years, the installation of marine drilling platforms and similar offshore structures has been simplified through the use of rupturable seal assemblies for the piling guides. These seal assemblies generally close the lower ends of the upright tubular legs, or piling guides, of the marine drilling platforms. The diaphragms are flexible and to some degree elastic and are made typically of nylon corded rubber. However, with these as used herebefore rupture as by a pile being driven through the diaphragm closure leaves large pieces of reinforced rubber behind to interfere with later use of the tubular pile insert or with the insertion therethrough of drilling augers. Alternate tube bottom closure approaches using steel closures are very limited in the size they can fold down into for removal. Expense of closure and destructive waste of enclosure are also serious considerations as well as the sureness and long term integrity of the seal provided.

It is, therefore, a principal object of this invention to provide a diaphragm seal assembly for closing tubes that is a pull-out closure structure substantially entirely removable other than for fixed rings welded to the inner diameter of the tube.

Another object is to provide a seal assembly where a single pull on a cable from above removes all closure items removable from the tube.

A further object is to provide a pull-out seal assembly of the heavy-duty reinforced type capable of withstanding relatively high water pressures over a relatively large area, having an excellent seal that is enhanced with increasing depths of water immersion and pressure.

Another object is to provide a pull-out seal assembly saving diaphragm seal closure components intact for reuse.

Features of this invention useful in accomplishing the above objects include a diaphragm closure constructed to resist heavy loading retained in place in such manner as to be nearly completely removed by pull on a cable from above. This is accomplished through use of a split ring retained in place by a key member maintained larger diameter between upper and lower rings welded to the inner wall of the tube. Pull on the cable removes the key, allowing the split ring to return to an initial smaller diameter size small enough to be removed up out of the tube along with the diaphragm closure.

Specific embodiments representing what are presently regarded as the best modes of carrying out the invention are illustrated in the accompanying drawings.

Figure 2:
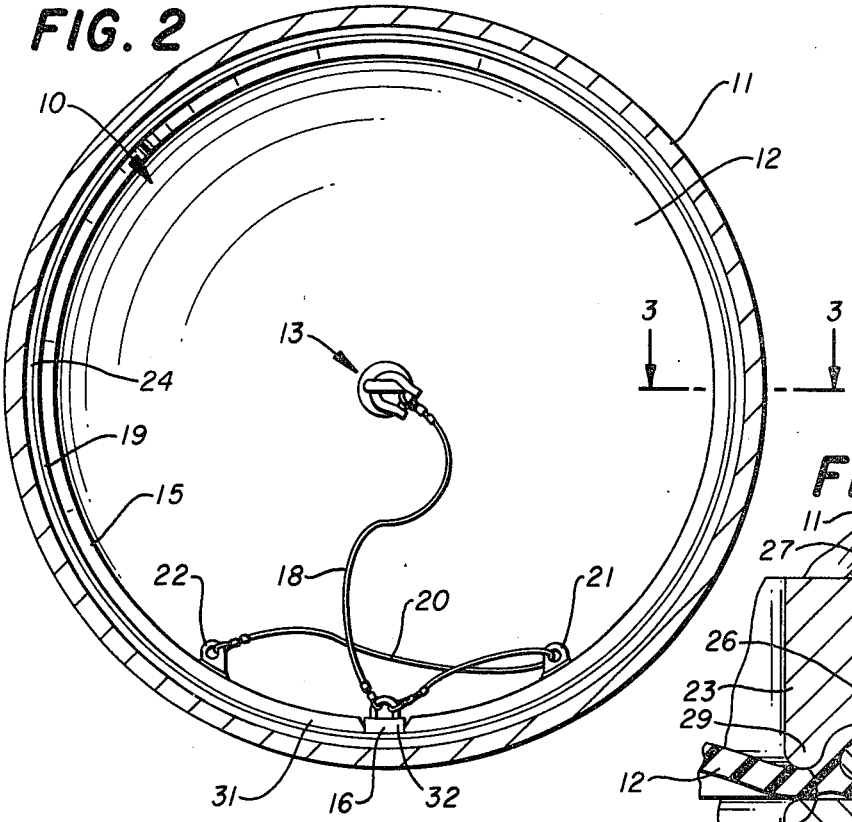
Figure 3:
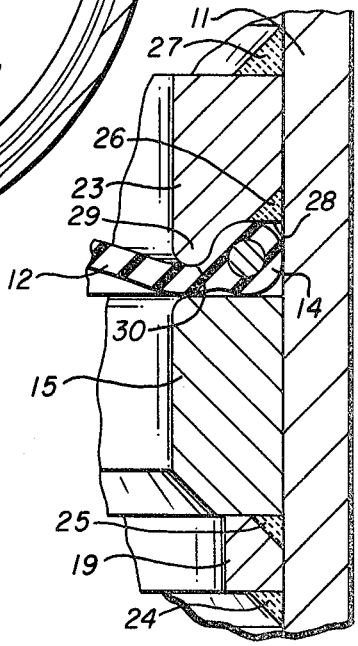
Figure 4:
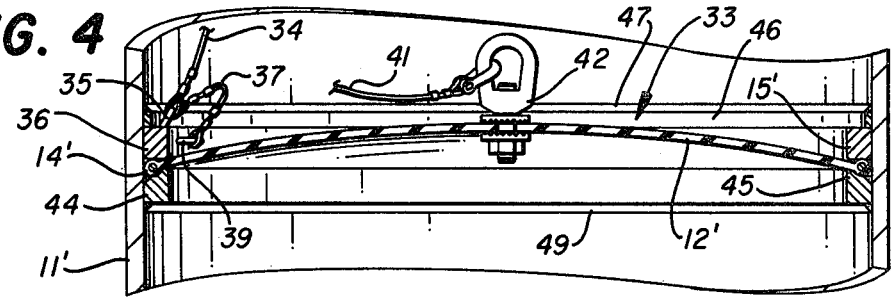
Figure 5:
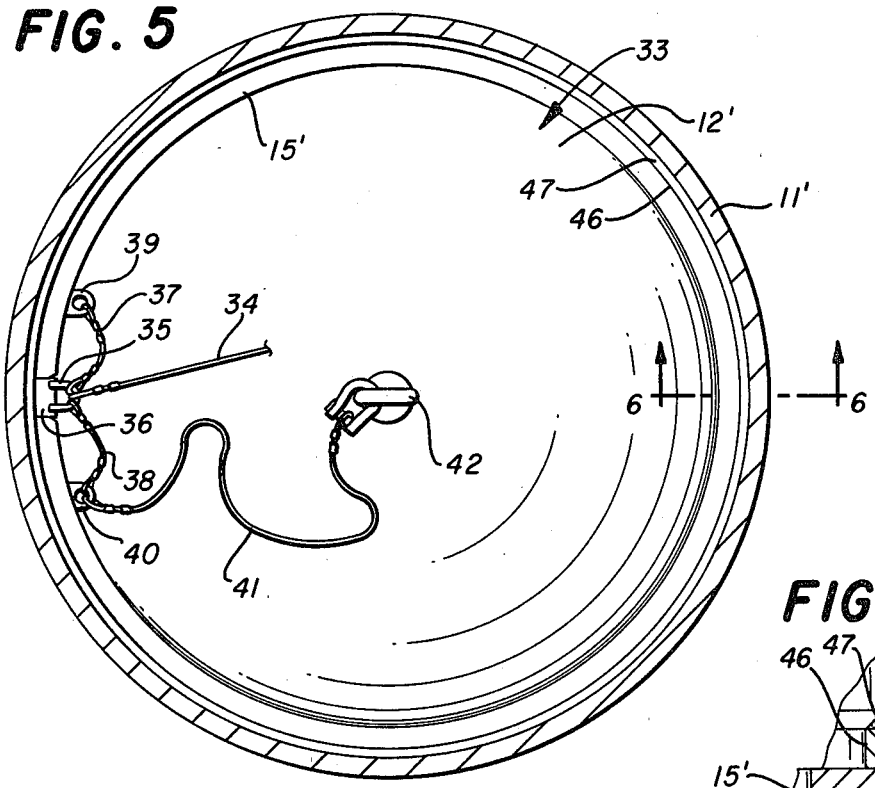
Figure 6:
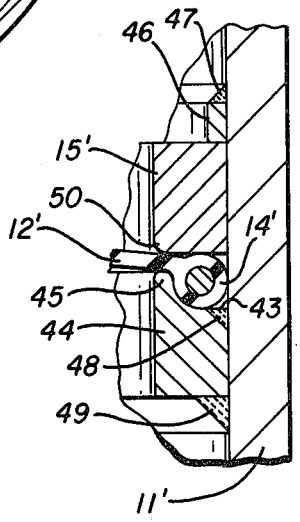
Figure 7:
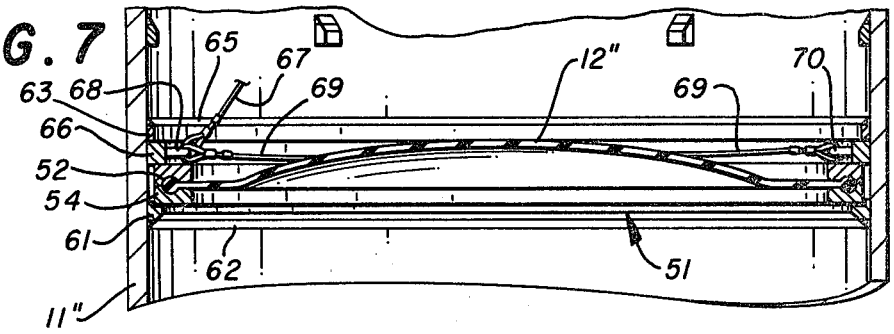
Figure 8:
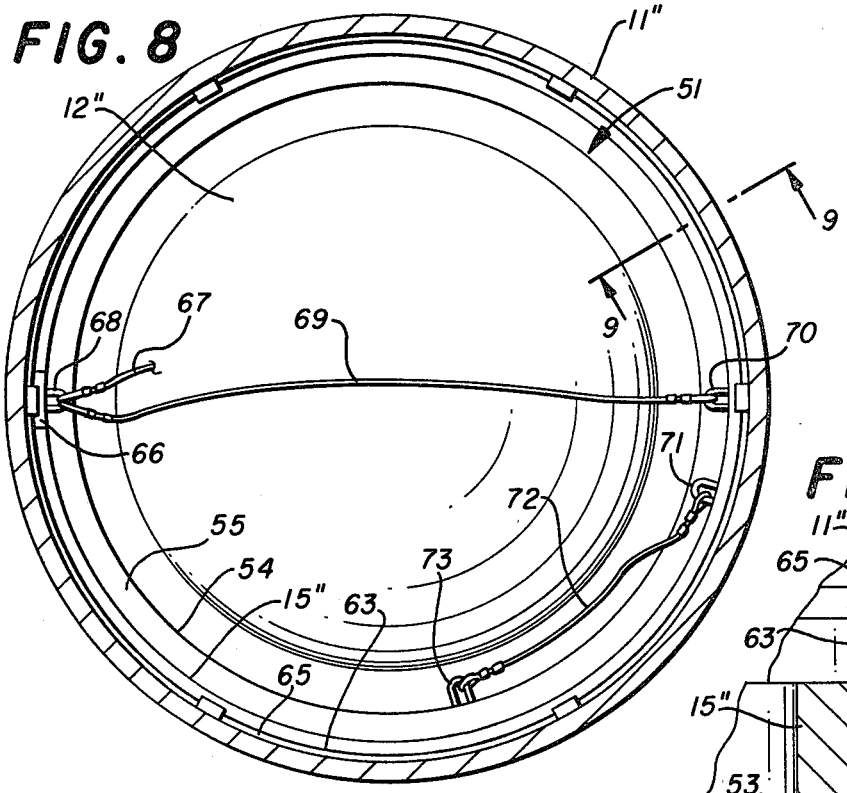
Figure 9:
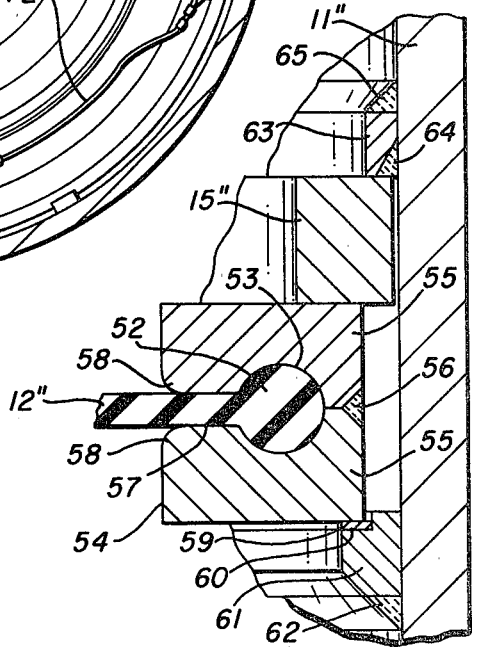

In the drawings:

FIG. 1 represents a side elevation sectioned view of a pull-out diaphragm seal assembly for use in water immersible hollow tubular members such as underwater piling guides;

FIG. 2, a partially sectioned bottom view of the diaphragm seal assembly of FIG. 1 in place in a hollow tubular member;

FIG. 3, an enlarged sectioned view taken along line 3—3 of FIG. 2 showing structural detail more clearly;

FIG. 4, a side elevation sectioned view of another pull-out diaphragm seal assembly embodiment for use in water immersible hollow tubular members;

FIG. 5, a partially sectioned top plan view of the diaphragm seal assembly of FIG. 4 in place in a hollow tubular member;

FIG. 6, an enlarged sectioned view taken along line 6—6 of FIG. 5 showing structural detail more clearly;

FIG. 7, a side elevation sectioned view of still another pull-out diaphragm seal assembly embodiment for use in water immersible hollow tubular members;

FIG. 8, a broken away and sectioned top plan view of the diaphragm seal assembly of FIG. 7 in place in a hollow tubular member; and FIG. 9, an enlarged sectioned view taken along line 9—9 of FIG. 8 showing structural detail more clearly.

Referring to the drawings:

The seal assembly 10 of FIGS. 1, 2 and 3 is shown mounted in a hollow tubular piling guide 11, generally in the lower end thereof, within which tubular piling may be placed, or through which a drilling auger with drive stem may pass after the seal assembly 10 is removed. Included as part of seal assembly 10 are pull-out flexible diaphragm 12 with eye bolt assembly 13 at the center and an enlarged wrapped around reinforcing ring 14 around and forming the periphery thereof along with a metal spring split ring 15 forced apart by a removable key 16 and thereby held in place. These elements are removable from their retained position within tube 11 by pulling of pullout cable 17 from above to pull eye bolt assembly 13 through and from diaphragm 12, and with continued pulling of cable 17 pulling of key cable 18, interconnecting the eye bolt assembly 13 and the key 16, to remove key 16 to thereby permit spring split ring 15 to collapse sufficiently to clear restriction presented by lower retainer ring 19. Then with spring split ring 15 in the suspended state it may be drawn up with further continued pulling of cable 17 and key cable 18, and with pulling of cable 20, interconnecting key 16 through eye 21 of ring 15 to final connection with ring eye 22, passing of the split ring 15 upward through upper retainer ring 23.

The lower retainer ring 19 is welded to the inner wall of tube 11 by annular welding beads 24 and 25, and upper retainer ring 23 is welded to the inner wall of tube 11 by annular welding beads 26 and 27. The lower retainer ring 19 and the upper retainer ring 23 are so spaced as to confine split ring 15 and diaphragm 12 therebetween with the bottom of upper retainer ring 23 having an annular recess 28 to accommodate the greater thickness of enlarged wrapped around reinforcing ring 14 of the diaphragm 12 that is defined by inner annular bottom ridge 29. It is important to note that the rounded smooth bottom surface 30 of ring 23 in contact with the upper surface of the rubber like material of the diaphragm 12 just radially inward from ring 14 to form a very effective annular seal preventing water leakage around the diaphragm 12 to the interior of tube 11 above the diaphragm 12. This annular seal generally becomes more effective with increased water pressure at greater depths of immersion at sea without presenting sharp edges creating undesired stress cutting of the diaphragm material. In addition the top 31 of split ring 15 and the top 32 of removable key 16 are flat to facilitate radially inward movement of the key 16 under the peripheral ring 14 edge of the diaphragm 12 and radially inward movement of split ring 12 when permitted by removal of key 16 from between the split ends of split ring 15. Thus, there is hereby provided a structure with the embodiment of FIGS. 1, 2 and 3, where with pulling of eye bolt assembly 13 upward, with upward tension pulling of cable 17, a destructive pulling of the eye bolt assembly 13 through the diaphragm, and subsequent pulling of cable 18 to remove key from between the open split ends of split ring 15 allowing the split ring to return to its initial size small enough to be removed up out of the tubular member along with the diaphragm 12 hanging on cable 18. With this action the only items left in the tube are lower ring 19 and upper ring 23 welded to the inner wall of tube 11. Since the diaphragm 12 closure is flexible it can be moved out of the tube 11 past minor obstructions along with split ring 15 in an on-edge state relative to the tube 11 as it is being pulled upward therethrough. Thus substantially the entire reinforced pressure closure is removed, instead of leaving large pieces of reinforced rubber behind as is the case with ruptured diaphragms of preexisting closures that are pierced by piling or drilling augers, with a single sustained pull on the cable structure accomplishing this complete removal.

The pull-out seal assembly 33 embodiment of FIGS. 4, 5 and 6 has many features in common with the embodiment of FIGS. 1, 2 and 3 with, however, the metal split ring 15′ counterpart of split ring 15 above the pull-out diaphragm 12′ rather than below. With this embodiment the pull cable 34 from above is connected directly to the pull ring 35 of split ring key 36 that in turn is connected through cables 37 and 38 to split ring pull rings 39 and 40, and an additional cable 41 interconnects split ring pull ring 40 and an eye bolt assembly 42 at the center of pull-out diaphragm 12′. The reinforcing ring 14′ projects primarily below diaphragm 12′ to be received within top annular recess 43 of lower ring 44 between annular ridge 45 of ring 44 and the inner wall of the tube 11′ where it is held captured in place by split ring 15′ thereabove. Split ring 15′ is held down in place in its expanded diameter state with key 36 between its split ends by upper retainer ring 46 that is welded to the inner wall of tube 11′ by annular welding bead 47. The lower retainer ring 44 is welded to the inner wall of tube 11′ by annular welding beads 48 and 49. Here it is important to note that the inner lower corner 50 of split ring 15′ and correspondingly of key 36 is rounded and smooth to form, in contact with the upper surface of the rubber-like material of the diaphragm 12′, a very effective annular seal preventing water leakage around the diaphragm 12′ to the interior of the tube 11′ above the diaphragm 12′. This annular seal generally becomes more effective with increased water pressure at greater depths of immersion at sea without presenting sharp edges creating undesired stress cutting of the diaphragm material. With this embodiment upward tension pulling of the upwardly extending cable 34 first pulls key 36 via pulling on pull ring 35, removing split ring key 36 to permit the split ring to shrink to its smaller diameter that would clear retaining ring 46. With the continued pulling of cable 34 as translated thereafter through additional cables 37 and 38 to pull rings 39 and 40 of the split ring 15′, the ring is pulled upward, and then as translated through cable 41 the diaphragm 12′ is pulled upward through and from the tube 11′.

The pull-out seal assembly 51 embodiment of FIGS. 7, 8 and 9, while having many features in common with the two previously described embodiments, is designed, generally, for larger structures using larger diameter tubes 11″. The pull-out diaphragm 12″ here has an enlarged annular reinforcing ring 52 capture enclosed within annular opening 53 within diaphragm annular metal rim 54 made of mirror image halves 55 welded 56 together. The thickness of the diaphragm 12″ is accommodated in the slot 57 with outer edge corners thereof rounded 58 to minimize stress damage to diaphragm 12″ with pressure loading thereon. The diaphragm rim 54 is seated on an annular rubber sheet washer 59 held on shoulder 60 of lower retainer ring 61 that is welded 62 to the inner wall of tube 11″. The metal split ring 15″ is above the pull-out diaphragm 12″ and is confined in its enlarged diameter state beneath upper retainer ring 63 that is welded to the inner wall of tube 11″ by annular welding beads 64 and 65. Key 66 spacing the split ends of split ring 15″ is removed first by upward tension pulling of the upwardly extending cable 67 via pulling on pull ring 68 with the split ring shrinking to its smaller diameter that clears upper retainer ring 63.

We claim:

1. In combination with a water immersible hollow tubular member such as an underwater piling guide and the like, a pull-out seal assembly for closing the immersible end of the hollow tubular member, including: a closure having an enlarged annular reinforcing ring; capture means for said annular reinforcing ring including, upper ring means fastened to the inner wall of said hollow tubular member, and a split ring having removable key means positioned between split ring ends and removable from between said split ring ends with the split ring at its maximum diameter size with said key means in place between split ring ends held in place captive along with said enlarged annular reinforcing ring between said upper ring means and said lower ring means; tension pull means connected to said removable key means, said split ring, and said closure for removing said key means, said split ring and said closure from the closure state in the hollow tubular member.

2. The seal assembly of claim 1, wherein said closure is a flexible diaphragm closure; and said enlarged annular reinforcing ring is an enlarged diaphragm annular reinforcing ring.

3. The seal assembly of claim 2, wherein capture means for said diaphragm annular reinforcing ring includes, rounded smooth bottom surface means on diaphragm retaining ring means forming an annular seal with the upper surface of the material of the diaphragm radially inward from the diaphragm reinforcing ring to seal against water leakage with a seal becoming more effective with increased water pressure at greater depths of water immersion.

4. The seal assembly of claim 3, wherein said rounded smooth bottom surface means is at the bottom of an annular bottom ridge on said upper ring means fastened to the inner wall of said hollow tubular member.

5. The seal assembly of claim 3, wherein said rounded smooth bottom surface means is on the bottom of said split ring and continuing on the bottom of said key means, which, with the key means in place between the split ring ends, forms said rounded smooth bottom surface as a rounded inner annular corner running around the bottom inner corner of said split ring and said key member, with said split ring positioned above said diaphragm annular reinforcing ring.

6. The seal assembly of claim 5, wherein said lower ring means is provided with a top annular recess receiving and holding said diaphragm enlarged annular reinforcing ring when said split ring is in position in its enlarged diameter state with said key member in place between the split ring ends.

7. The seal assembly of claim 3, wherein said rounded smooth bottom surface means is on the radially inner corner of the top of a slot in a metal ring enclosing said diaphragm reinforcing ring.

8. The seal assembly of claim 7, wherein said metal ring enclosing said diaphragm reinforcing ring is seated on shoulder means of said lower ring means fastened to the inner wall of said hollow tubular member.

9. The seal assembly of claim 8, wherein said split ring is in its expanded diameter state with said key means between the split ring split ends in captive position between said upper ring means fastened to the inner wall of said hollow tubular member and the top of said metal ring enclosing said diaphragm reinforcing ring.

10. The seal assembly of claim 9, wherein said tension pull means includes cable means extended down the hollow tubular member from above to connection with said removable key means; a cable interconnected between said key means and said split ring; and cable means interconnect between said split ring and said metal ring enclosing said diaphragm reinforcing ring.

11. The seal assembly of claim 3, wherein said tension pull means includes cable means extended down the hollow tubular member from above to connection with said removable key means, said split ring and with said flexible diaphragm.

12. The seal assembly of claim 11, wherein said split ring is positioned below said diaphragm between said enlarged annular reinforcing ring and said lower ring means.

13. The seal assembly of claim 12, wherein said tension pull means includes a cable connection to an eye bolt assembly positioned in said flexible diaphragm and extending through the diaphragm from one side to the other, a cable connection from said eye bolt assembly to said key member, and cable means connection on to said split ring.

14. The seal assembly of claim 13, wherein an annular recess is provided in the bottom of said upper ring means to hold said diaphragm enlarged annular reinforcing ring in a captured state therein and above said split ring.

15. The seal assembly of claim 11, wherein the said split ring is positioned above said diaphragm between said enlarged diaphragm reinforcing annular ring and said upper ring means fastened to the inner wall of said hollow tubular member.

16. The seal assembly of claim 15, wherein said tension pull means includes a cable connection to said removable key means, and successively from said removable key means through additional cable connection means to said split ring, and with additional cable extension means connected to said eye bolt assembly positioned in said flexible diaphragm.

17. The seal assembly of claim 16, wherein an annular recess is provided in the top of said lower ring means fastened to the inner wall of said hollow tubular member to hold said diaphragm enlarged annular reinforcing ring in a captive state therein and below said split ring.

18. In combination with a water immersible hollow tubular member such as an underwater piling guide and the like, a pull-out seal assembly for closing the immersible end of the hollow tubular member, including: a closure having an enlarged annular reinforcing ring; capture means for said annular reinforcing ring including, upper ring means fastened to the inner wall of said hollow tubular member; lower ring means fastened to the inner wall of said hollow tubular member, and split ring means expandable to a maximum diameter size and contractable to smaller diameter sizes and when expanded to its maximum diameter size held in place captive along with said enlarged annular reinforcing ring between said upper ring means and said lower ring means; and tension pull means connected to said split ring means and said closure for removing said split ring means and said closure from the closure state in the hollow tubular member.

19. The seal assembly of claim 18, wherein said split ring means is snap ring means with said tension pull means connected to said snap ring means.

* * * * *